US009651300B2

(12) United States Patent
Eaton

(10) Patent No.: US 9,651,300 B2
(45) Date of Patent: May 16, 2017

(54) SEMI-CLOSED LOOP LNG PROCESS

(71) Applicant: CONOCOPHILLIPS COMPANY, Houston, TX (US)

(72) Inventor: Anthony P. Eaton, San Ramon, CA (US)

(73) Assignee: CONOCOPHILLIPS COMPANY, Houston, TX (US)

( * ) Notice: Subject to any disclaimer, the term of this patent is extended or adjusted under 35 U.S.C. 154(b) by 827 days.

(21) Appl. No.: 13/963,508

(22) Filed: Aug. 9, 2013

(65) Prior Publication Data

US 2013/0327085 A1 Dec. 12, 2013

Related U.S. Application Data

(60) Continuation of application No. 12/144,258, filed on Jun. 23, 2008, now abandoned, which is a division of (Continued)

(51) Int. Cl.
*F25J 1/02* (2006.01)
*F25J 1/00* (2006.01)

(52) U.S. Cl.
CPC ..... *F25J 1/0022* (2013.01); *F25J 1/004* (2013.01); *F25J 1/0045* (2013.01); *F25J 1/0052* (2013.01);

(Continued)

(58) Field of Classification Search
CPC ..... F25J 1/0022; F25J 1/0082; F25J 1/0207; F25J 1/0208; F25J 1/0249; F25B 2500/23;

(Continued)

(56) References Cited

U.S. PATENT DOCUMENTS 3,020,723 A 2/1962 De Lury et al.
3,408,824 A * 11/1968 Karbosky ..... F25J 1/0207 62/612

(Continued)

FOREIGN PATENT DOCUMENTS

EP 0599443 B1 9/1997

OTHER PUBLICATIONS

PCT/US05/19620 International Search Report dated Dec. 29, 2009 (Form PCT/IB/373, dated Jan. 2004.

(Continued)

*Primary Examiner* — John F Pettitt
(74) *Attorney, Agent, or Firm* — ConocoPhillips Company

(57) ABSTRACT

A semi-closed loop system for producing liquefied natural gas (LNG) that combines certain advantages of closed-loop systems with certain advantages of open-loop systems to provide a more efficient and effective hybrid system. In the semi-closed loop system, the final methane refrigeration cycle provides significant cooling of the natural gas stream via indirect heat transfer, as opposed to expansion-type cooling. A minor portion of the LNG product from the methane refrigeration cycle is used as make-up refrigerant in the methane refrigeration cycle. A pressurized portion of the refrigerant from the methane refrigeration cycle is employed as fuel gas. Excess refrigerant from the methane refrigeration cycle can be recombined with the processed natural gas stream, rather than flared.

8 Claims, 2 Drawing Sheets

Figure 1:
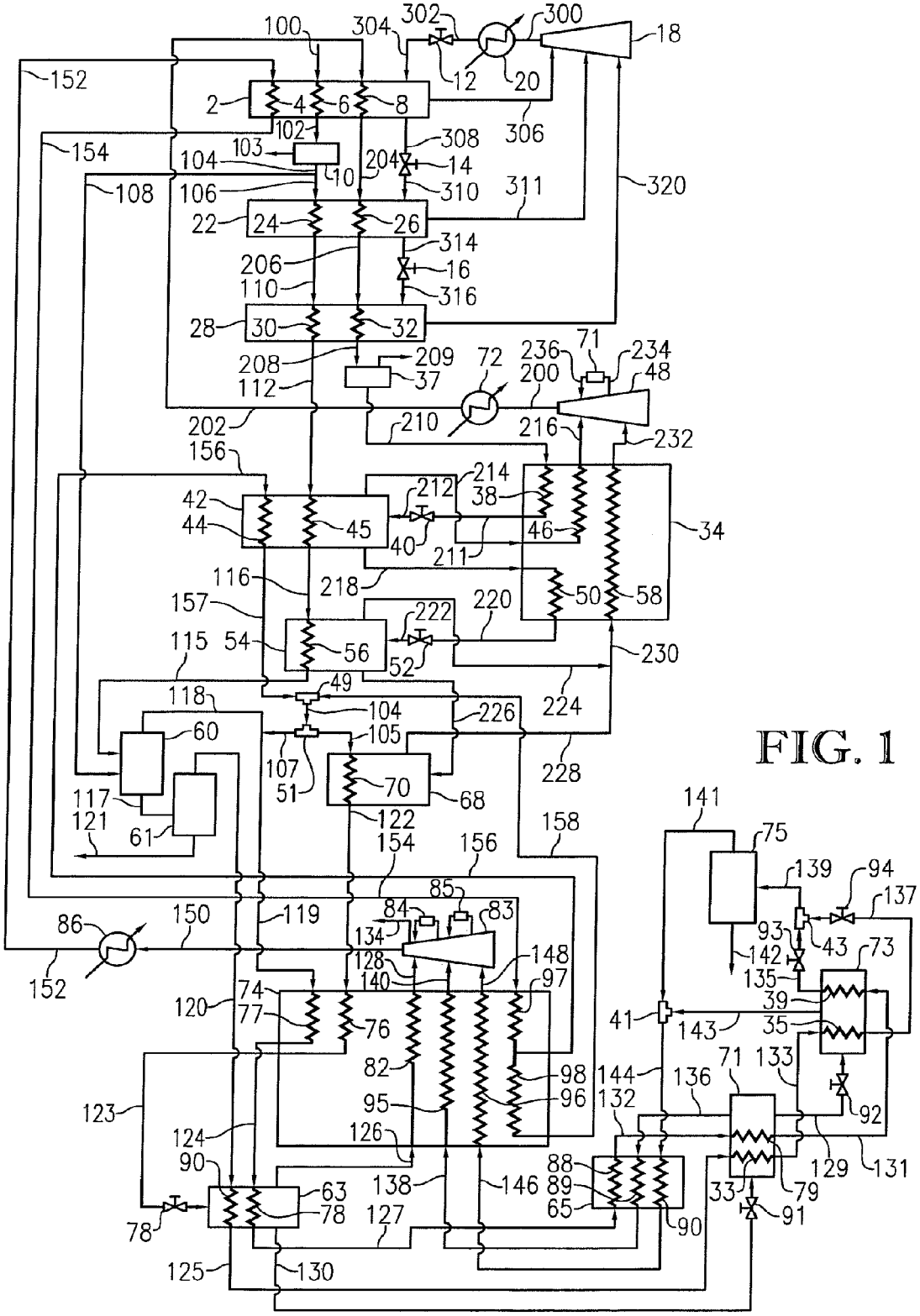

Related U.S. Application Data application No. 10/869,599, filed on Jun. 16, 2004, now Pat. No. 7,866,184.

(52) U.S. Cl.
CPC ..... *F25J 1/0082* (2013.01); *F25J 1/0085* (2013.01); *F25J 1/0087* (2013.01); *F25J 1/0095* (2013.01); *F25J 1/021* (2013.01); *F25J 1/023* (2013.01); *F25J 1/025* (2013.01); *F25J 1/0207* (2013.01); *F25J 1/0218* (2013.01); *F25J 1/0244* (2013.01); *F25J 1/0265* (2013.01); *F25J 2220/64* (2013.01)

(58) Field of Classification Search
CPC ..... F25B 2600/05; F25B 2600/2503; F25B 2600/2523; F25B 2400/16; F25B 45/00
See application file for complete search history.

(56) References Cited

U.S. PATENT DOCUMENTS 3,413,816 A * 12/1968 De Marco ..... F25J 1/0207 62/222
3,440,828 A 4/1969 Pryor et al.
3,596,472 A 8/1971 Streich
3,690,114 A 9/1972 Swearingen et al.
4,084,405 A * 4/1978 Schibbye ..... F25B 1/047 62/197
4,172,711 A 10/1979 Bailey
4,195,979 A 4/1980 Martin
4,541,852 A 9/1985 Newton
4,566,288 A * 1/1986 O'Neal ..... F25B 41/04 62/117
6,449,982 B1 9/2002 Fischer
6,722,157 B1 4/2004 Eaton et al.
7,866,184 B2 1/2011 Eaton

OTHER PUBLICATIONS

EP Application No. EP05757608 dated Dec. 12, 2013—Supplementary European Search Report.

* cited by examiner

SEMI-CLOSED LOOP LNG PROCESS

CROSS-REFERENCE TO RELATED APPLICATIONS

This application is a continuation application of Ser. No. 12/144,258, filed on Jun. 23, 2008, which is a divisional of Ser. No. 10/869,599, filed on Jun. 16, 2004, both of which are hereby incorporated by reference.

BACKGROUND OF THE INVENTION

1. Field of the Invention

This invention relates to a method and apparatus for liquefying natural gas. In another aspect, the invention concerns an improved liquified natural gas (LNG) facility employing a semi-closed loop methane refrigeration cycle.

2. Description of the Prior Art

The cryogenic liquefaction of natural gas is routinely practiced as a means of converting natural gas into a more convenient form for transportation and storage. Such liquefaction reduces the volume of the natural gas by about 600-fold and results in a product which can be stored and transported at near atmospheric pressure.

Natural gas is frequently transported by pipeline from the supply source to a distant market. It is desirable to operate the pipeline under a substantially constant and high load factor but often the deliverability or capacity of the pipeline will exceed demand while at other times the demand may exceed the deliverability of the pipeline. In order to shave off the peaks where demand exceeds supply or the valleys when supply exceeds demand, it is desirable to store the excess gas in such a manner that it can be delivered when demand exceeds supply. Such practice allows future demand peaks to be met with material from storage. One practical means for doing this is to convert the gas to a liquefied state for storage and to then vaporize the liquid as demand requires.

The liquefaction of natural gas is of even greater importance when transporting gas from a supply source which is separated by great distances from the candidate market and a pipeline either is not available or is impractical. This is particularly true where transport must be made by ocean-going vessels. Ship transportation in the gaseous state is generally not practical because appreciable pressurization is required to significantly reduce the specific volume of the gas. Such pressurization requires the use of more expensive storage containers.

In order to store and transport natural gas in the liquid state, the natural gas is preferably cooled to −240° F. to −260° F. where the liquefied natural gas (LNG) possesses a near-atmospheric vapor pressure. Numerous systems exist in the prior art for the liquefaction of natural gas in which the gas is liquefied by sequentially passing the gas at an elevated pressure through a plurality of cooling stages whereupon the gas is cooled to successively lower temperatures until the liquefaction temperature is reached. Cooling is generally accomplished by indirect heat exchange with one or more refrigerants such as propane, propylene, ethane, ethylene, methane, nitrogen, carbon dioxide, or combinations of the preceding refrigerants (e.g., mixed refrigerant systems).

In the past, many conventional LNG facilities have used a methane refrigeration cycle (i.e., a refrigeration cycle employing a predominately methane refrigerant) as the final refrigeration cycle for liquefying natural gas. Some conventional LNG facilities utilize an open-loop methane refrigeration cycle, while others use a closed-loop methane refrigeration cycle. In a closed-loop methane refrigeration cycle, the predominately methane refrigerant is not derived from or combined with the natural gas stream being liquefied. In an open loop methane refrigeration cycle, the predominately methane refrigerant is derived from the natural gas undergoing liquefaction, and at least part of the predominately methane refrigerant is recombined with the natural gas stream undergoing liquefaction.

Conventional open-loop and closed-loop methane refrigeration cycles each have their own unique advantages and disadvantages. One disadvantage of conventional closed-loop systems is that a fuel gas compressor is required to compress fuel gas used to power the drivers (e.g., gas turbines) that drive the main refrigerant compressors. Another disadvantage of closed-loop systems is that most closed-loop systems produce an excess of fuel gas that is simply flared from the system. These fuel gas-related problems of closed-loop systems are not common to open-loop systems. However, open-loop systems have their own unique disadvantages. For example, most open-loop systems require the natural gas stream entering the open loop refrigeration cycle to be fully condensed. Further, in open-loop LNG facilities utilizing a demethanizer column for processing the heavies stream discharged from the bottom of the main heavies removal column, the overheads stream from the demethanizer column must be combined with the predominately methane refrigerant and/or compressed because of the pressure difference between the overheads stream from the debutanizer and the overheads stream from the heavies removal column.

Accordingly there is a need for an LNG facility that employs a hybrid methane refrigeration cycle that avoids the disadvantages of both closed-loop and open-loop systems, while still providing the various benefits of closed-loop and open-loop systems.

OBJECTS AND SUMMARY OF THE INVENTION

It is, therefore, an object of the present invention to provide a natural gas liquefaction system employing a methane refrigeration cycle that eliminates the need for a separate fuel gas compressor.

A further object of the invention is to provide a natural gas liquefaction system employing a methane refrigeration cycle that utilizes excess methane refrigerant in the process, rather than simply flaring the excess refrigerant.

Another object of the invention is to provide a natural gas liquefaction system employing a methane refrigeration cycle that does not require the natural gas feed stream to be fully condensed upstream of the methane refrigeration cycle.

Still another object of the invention is to provide a natural gas liquefaction system employing a methane refrigeration cycle that allows the overheads stream from the demethanizer column to be liquefied without compression and/or combination with the methane refrigerant.

It should be understood that the above objects are exemplary and need not all be accomplished by the invention claimed herein. Other objects and advantages of the invention will be apparent from the written description and drawings.

Accordingly, one aspect of the present invention concerns a method of liquefying natural gas comprising the steps of (a) cooling the natural gas at least 40E F via indirect heat exchange with a predominantly methane refrigerant, thereby providing liquefied natural gas; (b) flashing at least a portion of the liquefied natural gas to thereby provide a predominantly vapor fraction and a predominantly liquid fraction;

and (c) combining at least a portion of the predominantly vapor fraction with the predominantly methane refrigerant used to cool the natural gas in step (a).

Another aspect of the present invention concerns a method of liquefying natural gas comprising the steps of: (a) cooling the natural gas with a first refrigeration cycle employing a first refrigerant comprising less than 50 mole percent methane; (b) downstream of the first refrigeration cycle, separating the natural gas into a first lights stream and a first heavies stream in a first column; (c) separating the first lights stream into a second lights stream and a second heavies stream in a second column; and (d) cooling the second lights stream in a methane heat exchanger via indirect heat exchange with a predominantly methane refrigerant, step (d) being performed without first combining the second lights stream with the predominantly methane refrigerant.

A further aspect of the present invention concerns a method of liquefying natural gas comprising the steps of: (a) cooling a natural gas stream with a first refrigeration cycle via indirect heat exchange with a first refrigerant comprising predominantly propane, propylene, or carbon dioxide; (b) downstream of the first refrigeration cycle, cooling the natural gas stream with a second refrigeration cycle via indirect heat exchange with a second refrigerant comprising predominantly ethane, ethylene, or carbon dioxide; (c) downstream of the second refrigeration cycle, cooling the natural gas stream at least 40E F with a methane refrigeration cycle via indirect heat exchange with a predominantly methane refrigerant; and (d) cooling at least a portion of the predominantly methane refrigerant in the second refrigeration cycle via indirect heat exchange with the second refrigerant.

Still another aspect of the present invention concerns an apparatus for liquefying natural gas comprising: (a) a first refrigeration cycle employing a first refrigerant to cool the natural gas via indirect heat exchange therewith; (b) a methane refrigeration cycle positioned downstream of the first refrigeration cycle and employing a predominantly methane refrigerant to cool the natural gas at least 40E F via indirect heat exchange therewith, thereby producing liquefied natural gas; (c) an expansion device operable to flash the liquefied natural gas and thereby produce a predominantly vapor fraction and a predominantly liquid fraction. The methane refrigeration cycle includes a make-up refrigerant inlet for receiving at least a portion of the predominantly vapor fraction produced by the expansion device and combining of the predominantly vapor fraction with the predominantly methane refrigerant.

BRIEF DESCRIPTION OF THE DRAWING FIGURES

Figure 2:
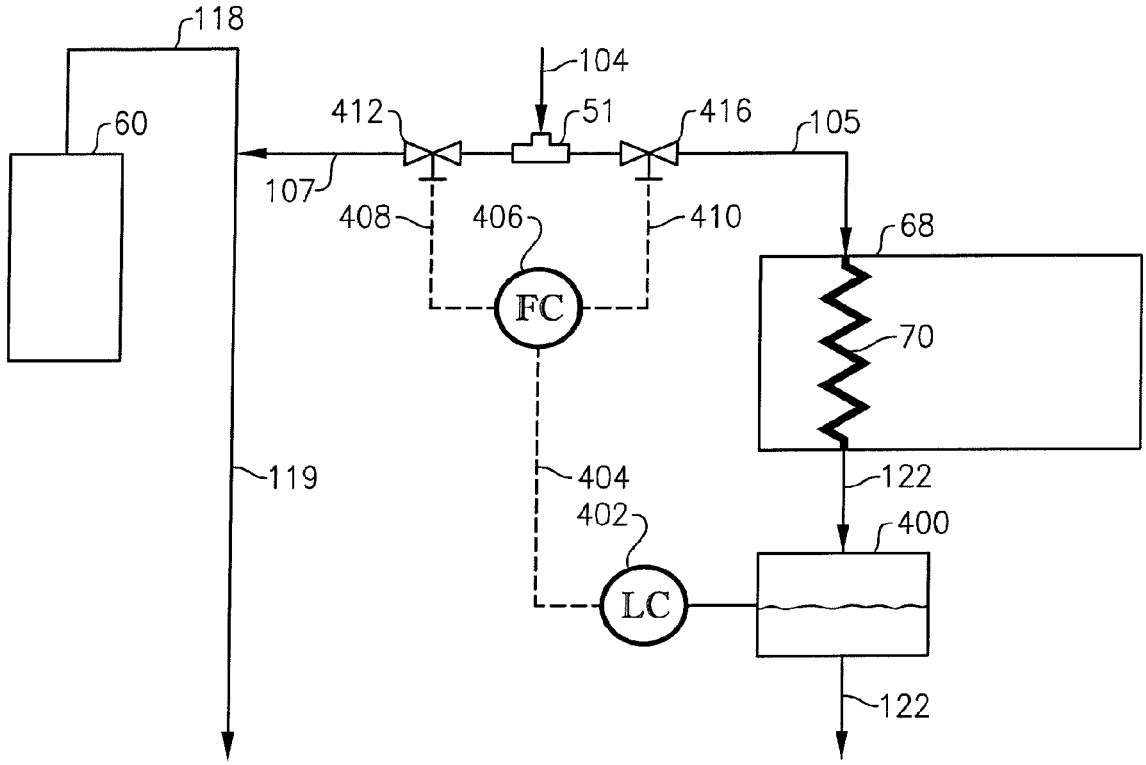

A preferred embodiment of the present invention is described in detail below with reference to the attached drawing figures, wherein:

FIG. 1 is a simplified flow diagram of a cascaded refrigeration process for LNG production which employs a semi-closed loop methane refrigeration cycle; and FIG. 2 is a flow diagram providing greater detail regarding the system for controlling the amount of predominately methane refrigerant introduced into the natural gas stream being liquefied.

DETAILED DESCRIPTION OF THE PREFERRED EMBODIMENT

As used herein, the terms "predominantly", "primarily", "principally", and "in major portion", when used to describe the presence of a particular component of a fluid stream, shall mean that the fluid stream comprises at least 50 mole percent of the stated component. For example, a "predominantly" methane stream, a "primarily" methane stream, a stream "principally" comprised of methane, or a stream comprised "in major portion" of methane each denote a stream comprising at least 50 mole percent methane. As used herein, the terms "upstream" and "downstream" shall be used to describe the relative positions of various components or processes of a natural gas liquefaction plant along the main flow path of natural gas through the plant.

A cascaded refrigeration process uses one or more refrigerants for transferring heat energy from the natural gas stream to the refrigerant and ultimately transferring said heat energy to the environment. In essence, the overall refrigeration system functions as a heat pump by removing heat energy from the natural gas stream as the stream is progressively cooled to lower and lower temperatures. The design of a cascaded refrigeration process involves a balancing of thermodynamic efficiencies and capital costs. In heat transfer processes, thermodynamic irreversibilities are reduced as the temperature gradients between heating and cooling fluids become smaller, but obtaining such small temperature gradients generally requires significant increases in the amount of heat transfer area, major modifications to various process equipment, and the proper selection of flow rates through such equipment so as to ensure that both flow rates and approach and outlet temperatures are compatible with the required heating/cooling duty.

In a typical LNG facility, various pretreatment steps provide a means for removing certain undesirable components, such as acid gases, mercaptan, mercury, and moisture from the natural gas feed stream delivered to the facility. The composition of this gas stream may vary significantly. As used herein, a natural gas stream is any stream principally comprised of methane which originates in major portion from a natural gas feed stream, such feed stream for example containing at least 85 mole percent methane, with the balance being ethane, higher hydrocarbons, nitrogen, carbon dioxide, and a minor amount of other contaminants such as mercury, hydrogen sulfide, and mercaptan. The pretreatment steps may be separate steps located either upstream of the cooling cycles or located downstream of one of the early stages of cooling in the initial cycle. The following is a non-inclusive listing of some of the available means which are readily known to one skilled in the art. Acid gases and to a lesser extent mercaptan are routinely removed via a chemical reaction process employing an aqueous amine-bearing solution. This treatment step is generally performed upstream of the cooling stages in the initial cycle. A major portion of the water is routinely removed as a liquid via two-phase gas-liquid separation following gas compression and cooling upstream of the initial cooling cycle and also downstream of the first cooling stage in the initial cooling cycle. Mercury is routinely removed via mercury sorbent beds. Residual amounts of water and acid gases are routinely removed via the use of properly selected sorbent beds such as regenerable molecular sieves.

The pretreated natural gas feed stream is generally delivered to the liquefaction process at an elevated pressure or is compressed to an elevated pressure generally greater than 500 psia, preferably about 500 psia to about 3000 psia, still more preferably about 500 psia to about 1000 psia, yet still more preferably about 600 psia to about 800 psia. The feed stream temperature is typically near ambient to slightly above ambient. A representative temperature range being 60° F. to 150° F.

As previously noted, the natural gas feed stream is cooled in a plurality of multistage cycles or steps (preferably three) by indirect heat exchange with a plurality of different refrigerants (preferably three). The overall cooling efficiency for a given cycle improves as the number of stages increases but this increase in efficiency is accompanied by corresponding increases in net capital cost and process complexity. The feed gas is preferably passed through an effective number of refrigeration stages, nominally two, preferably two to four, and more preferably three stages, in a first closed refrigeration cycle in indirect heat exchange with a relatively high boiling refrigerant. Such relatively high boiling point refrigerant is preferably comprised in major portion of propane, propylene, or mixtures thereof, more preferably the refrigerant comprises at least about 75 mole percent propane, even more preferably at least 90 mole percent propane, and most preferably the refrigerant consists essentially of propane. Thereafter, the processed feed gas flows through an effective number of stages, nominally two, preferably two to four, and more preferably two or three, in a second closed refrigeration cycle in indirect heat exchange with a refrigerant having a lower boiling point. Such lower boiling point refrigerant is preferably comprised in major portion of ethane, ethylene, or mixtures thereof, more preferably the refrigerant comprises at least about 75 mole percent ethylene, even more preferably at least 90 mole percent ethylene, and most preferably the refrigerant consists essentially of ethylene. Thereafter the processed feed gas flows through an effective number of stages, nominally two, preferably two to five, and more preferably three or four, in a third/methane refrigeration cycle in indirect heat exchange with a predominately methane refrigerant. Such predominately methane refrigerant preferably comprises at least about 75 mole percent methane, even more preferably at least about 90 mole percent methane, and most preferably the predominately methane refrigerant consists essentially of methane. In a particularly preferred embodiment, the predominately methane refrigerant comprises less than 10 mole percent nitrogen, most preferably less than 5 mole percent nitrogen.

Generally, the natural gas feed stream will contain such quantities of $C_2$+ components so as to result in the formation of a $C_2$+ rich liquid in one or more of the cooling stages. This liquid is removed via gas-liquid separation means, preferably one or more conventional gas-liquid separators. Generally, the sequential cooling of the natural gas in each stage is controlled so as to remove as much of the $C_2$ and higher molecular weight hydrocarbons as possible from the gas to produce a gas stream predominating in methane and a liquid stream containing significant amounts of ethane and heavier components. An effective number of gas/liquid separation means are located at strategic locations downstream of the cooling zones for the removal of liquids streams rich in $C_2$+ components. The exact locations and number of gas/liquid separation means, preferably conventional gas/liquid separators, will be dependant on a number of operating parameters, such as the $C_2$+ composition of the natural gas feed stream, the desired BTU content of the LNG product, the value of the $C_2$+ components for other applications, and other factors routinely considered by those skilled in the art of LNG plant and gas plant operation. The $C_2$+ hydrocarbon stream or streams may be demethanized via a single stage flash or a fractionation column. In the latter case, the resulting methane-rich stream can be directly returned at pressure to the liquefaction process. In the former case, this methane-rich stream can be repressurized and recycle or can be used as fuel gas. The $C_2$+ hydrocarbon stream or streams or the demethanized $C_2$+ hydrocarbon stream may be used as fuel or may be further processed, such as by fractionation in one or more fractionation zones to produce individual streams rich in specific chemical constituents (e.g., $C_2$, $C_3$, $C_4$, and $C_5$+).

The liquefaction process described herein may use one of several types of cooling which include but are not limited to (a) indirect heat exchange, (b) vaporization, and (c) expansion or pressure reduction. Indirect heat exchange, as used herein, refers to a process wherein the refrigerant cools the substance to be cooled without actual physical contact between the refrigerating agent and the substance to be cooled. Specific examples of indirect heat exchange means include heat exchange undergone in a shell-and-tube heat exchanger, a core-in-kettle heat exchanger, and a brazed aluminum plate-fin heat exchanger. The physical state of the refrigerant and substance to be cooled can vary depending on the demands of the system and the type of heat exchanger chosen. Thus, a shell-and-tube heat exchanger will typically be utilized where the refrigerating agent is in a liquid state and the substance to be cooled is in a liquid or gaseous state or when one of the substances undergoes a phase change and process conditions do not favor the use of a core-in-kettle heat exchanger. As an example, aluminum and aluminum alloys are preferred materials of construction for the core but such materials may not be suitable for use at the designated process conditions. A plate-fin heat exchanger will typically be utilized where the refrigerant is in a gaseous state and the substance to be cooled is in a liquid or gaseous state. Finally, the core-in-kettle heat exchanger will typically be utilized where the substance to be cooled is liquid or gas and the refrigerant undergoes a phase change from a liquid state to a gaseous state during the heat exchange.

Vaporization cooling refers to the cooling of a substance by the evaporation or vaporization of a portion of the substance with the system maintained at a constant pressure. Thus, during vaporization, the portion of the substance which evaporates absorbs heat from the portion of the substance which remains in a liquid state and hence, cools the liquid portion. Finally, expansion or pressure reduction cooling refers to cooling which occurs when the pressure of a gas, liquid or a two-phase system is decreased by passing through a pressure reduction means. In one embodiment, this expansion means is a Joule-Thomson expansion valve. In another embodiment, the expansion means is either a hydraulic or gas expander. Because expanders recover work energy from the expansion process, lower process stream temperatures are possible upon expansion.

The flow schematic and apparatus set forth in FIG. 1 represents a preferred embodiment of the inventive LNG facility employing a semi-closed loop methane refrigeration cycle. FIG. 2 represents a preferred embodiment of the system for controlling the amount of methane refrigerant introduced back into the processed natural gas stream being liquefied. Those skilled in the art will recognized that FIGS. 1 and 2 are schematics only and, therefore, many items of equipment that would be needed in a commercial plant for successful operation have been omitted for the sake of clarity. Such items might include, for example, compressor controls, flow and level measurements and corresponding controllers, temperature and pressure controls, pumps, motors, filters, additional heat exchangers, and valves, etc. These items would be provided in accordance with standard engineering practice.

To facilitate an understanding of FIGS. 1 and 2, the following numbering nomenclature was employed. Items numbered 1 through 99 are process vessels and equipment which are directly associated with the liquefaction process. Items numbered 100 through 199 correspond to flow lines or conduits which contain predominantly methane streams. Items numbered 200 through 299 correspond to flow lines or conduits which contain predominantly ethylene streams. Items numbered 300 through 399 correspond to flow lines or conduits which contain predominantly propane streams. Items numbered 400 through 499 in FIG. 2 are vessels, equipment, lines, or conduits of the system for controlling the amount of methane refrigerant introduced back into the processed natural gas stream being liquefied.

Referring to FIG. 1, in a first refrigeration cycle, gaseous propane is compressed in a multistage (preferably three-stage) compressor 18 driven by a gas turbine driver (not illustrated). The three stages of compression preferably exist in a single unit although each stage of compression may be a separate unit and the units mechanically coupled to be driven by a single driver. Upon compression, the compressed propane is passed through conduit 300 to a cooler 20 where it is cooled and liquefied. A representative pressure and temperature of the liquefied propane refrigerant prior to flashing is about 100° F. and about 190 psia. The stream from cooler 20 is passed through conduit 302 to a pressure reduction means, illustrated as expansion valve 12, wherein the pressure of the liquefied propane is reduced, thereby evaporating or flashing a portion thereof. The resulting two-phase product then flows through conduit 304 into a high-stage propane chiller 2 wherein gaseous methane refrigerant introduced via conduit 152, natural gas feed introduced via conduit 100, and gaseous ethylene refrigerant introduced via conduit 202 are respectively cooled via indirect heat exchange means 4, 6, and 8, thereby producing cooled gas streams respectively discharged via conduits 154, 102, and 204. The predominately methane refrigerant in conduit 154 is fed to a main methane economizer 74, which will be discussed in greater detail in a subsequent section.

The propane gas from chiller 2 is returned to compressor 18 through conduit 306. This gas is fed to the high-stage inlet port of compressor 18. The remaining liquid propane is passed through conduit 308, the pressure further reduced by passage through a pressure reduction means, illustrated as expansion valve 14, whereupon an additional portion of the liquefied propane is flashed. The resulting two-phase stream is then fed to an intermediate stage propane chiller 22 through conduit 310, thereby providing a coolant for chiller 22. The cooled feed gas stream from chiller 2 flows via conduit 102 to separation equipment 10 wherein gas and liquid phases are separated. The liquid phase, which can be rich in $C_3$+ components, is removed via conduit 103. The gaseous phase is removed via conduit 104 and then split into two separate streams which are conveyed via conduits 106 and 108. The stream in conduit 106 is fed to propane chiller 22. The stream in conduit 108 becomes the stripping gas to heavies removal column 60, discussed in more detail below. Ethylene refrigerant from chiller 2 is introduced to chiller 22 via conduit 204.

In intermediate-stage propane chiller 22, the feed gas stream, also referred to herein as the processed natural gas stream, and the ethylene refrigerant streams are respectively cooled via indirect heat transfer means 24 and 26, thereby producing cooled feed gas and ethylene refrigerant streams via conduits 110 and 206. The thus evaporated portion of the propane refrigerant is separated and passed through conduit 311 to the intermediate-stage inlet of compressor 18. Liquid propane refrigerant from chiller 22 is removed via conduit 314, flashed across a pressure reduction means, illustrated as expansion valve 16, and then fed to a low-stage propane chiller/condenser 28 via conduit 316.

As illustrated in FIG. 1, the feed gas stream flows from intermediate-stage propane chiller 22 to the low-stage propane chiller 28 via conduit 110. In chiller 28, the stream is cooled via indirect heat exchange means 30. In a like manner, the ethylene refrigerant stream flows from the intermediate-stage propane chiller 22 to low-stage propane chiller 28 via conduit 206. In the latter, the ethylene refrigerant may be totally condensed or condensed in nearly its entirety via indirect heat exchange means 32, although total condensation is not required. The vaporized propane refrigerant is removed from low-stage propane chiller 28 and returned to the low-stage inlet of compressor 18 via conduit 320.

As illustrated in FIG. 1, the feed gas stream exiting low-stage propane chiller 28 is introduced to high-stage ethylene chiller 42 via conduit 112. Ethylene refrigerant exits low-stage propane chiller 28 via conduit 208 and is preferably fed to a separation vessel 37 wherein light components are removed via conduit 209 and condensed ethylene is removed via conduit 210. The ethylene refrigerant at this location in the process is generally at a temperature of about −24° F. and a pressure of about 285 psia. The ethylene refrigerant then flows to an ethylene economizer 34 wherein it is cooled via indirect heat exchange means 38, removed via conduit 211, and passed to a pressure reduction means, illustrated as an expansion valve 40, whereupon the refrigerant is flashed to a preselected temperature and pressure and fed to high-stage ethylene chiller 42 via conduit 212. Vapor is removed from chiller 42 via conduit 214 and routed to ethylene economizer 34 wherein the vapor functions as a coolant via indirect heat exchange means 46. The ethylene vapor is then removed from ethylene economizer 34 via conduit 216 and fed to the high-stage inlet of ethylene compressor 48. The ethylene refrigerant which is not vaporized in high-stage ethylene chiller 42 is removed via conduit 218 and returned to ethylene economizer 34 for further cooling via indirect heat exchange means 50, removed from ethylene economizer via conduit 220, and flashed in a pressure reduction means, illustrated as expansion valve 52, whereupon the resulting two-phase product is introduced into a low-stage ethylene chiller 54 via conduit 222.

After cooling in indirect heat exchange means 45, the methane-rich stream is removed from high-stage ethylene chiller 42 via conduit 116. This stream is then condensed in part via cooling provided by indirect heat exchange means 47 in low-stage ethylene chiller 54, thereby producing a two-phase stream which flows via conduit 115 to heavies removal column 60. As previously noted, the feed gas stream in line 104 was split so as to flow via conduits 106 and 108. The contents of conduit 108, which is referred to herein as the stripping gas stream, flows to a lower inlet of heavies removal column 60. In heavies removal column 60, the two-phase stream introduced via conduit 115 is contacted with the cooled stripping gas stream introduced via conduit 108 in a countercurrent manner thereby producing a heavies-depleted overhead vapor stream via conduit 118 and a heavies-rich liquid stream via conduit 117. The heavies-rich liquid stream contains a significant concentration of $C_4$+ hydrocarbons, such as benzene, cyclohexane, other aromatics, and/or heavier hydrocarbon components. The heavies removal column overheads (lights) stream in conduit 118 is combined with a portion of the methane refrigerant from conduit 107, as discussed in detail below, and the combined stream is transferred via conduit 119 to main methane economizer 74 for cooling in an indirect heat transfer means 77. The heavies-rich stream discharged from the bottom of heavies removal column 60 via conduit 117 is subsequently separated into liquid and vapor portions or preferably is flashed or fractionated in demethanizer column 61. In either case, a heavies-rich liquid (bottoms) stream is produced via conduit 121 and a second methane-rich vapor (overheads) stream is produced via conduit 120.

As previously noted, the predominately methane refrigerant in conduit 154 is fed to main methane economizer 74 wherein the stream is cooled via indirect heat exchange means 97. A first portion of the resulting cooled compressed methane refrigerant stream from heat exchange means 97 is withdrawn from main methane economizer 74 via conduit 156, while a second portion of the methane refrigerant stream exiting heat exchange means 97 is introduced into indirect heat exchange means 98 for further cooling. The methane refrigerant in conduit 156 is introduced into high-stage ethylene chiller 42, wherein the methane refrigerant is cooled with the ethylene refrigerant in indirect heat exchange means 44. The resulting cooled methane refrigerant exits high-stage ethylene chiller 42 via conduit 157.

The cooled methane refrigerant stream from heat exchange means 98 is withdrawn from main methane economizer 74 via conduit 158 and then combined in a tee 49 with the cooled methane refrigerant in conduit 157. The combined methane refrigerant stream is transferred from tee 49 to tee 51 via conduit 104. Tee 51 is part of a control system (described in detail below with reference to FIG. 2) that directs a portion of the methane refrigerant stream out of the methane refrigeration cycle via conduit 107, and combines this portion of the methane refrigerant stream with the heavies removal column overheads stream in conduit 118. The remainder (i.e., uncombined portion) of the methane refrigerant flows via conduit 105 to a low-stage ethylene chiller 68. In low-stage ethylene chiller 68, the predominately methane refrigerant stream is cooled via indirect heat exchange means 70 with the liquid effluent from intermediate stage ethylene chiller 54, which is routed to low-stage ethylene chiller 68 via conduit 226. The cooled methane refrigerant product from low-stage ethylene chiller 68 is transferred via conduit 122 to main methane economizer 74. The ethylene vapor from low-stage ethylene chiller 54 (withdrawn via conduit 224) and low-stage ethylene chiller 68 (withdrawn via conduit 228) are combined and routed via conduit 230 to ethylene economizer 34 wherein the vapors function as a coolant via indirect heat exchange means 58. The stream is then routed via conduit 232 from ethylene economizer 34 to the low-stage inlet of ethylene compressor 48.

As noted in FIG. 1, the compressor effluent from vapor introduced via the low-stage side of ethylene compressor 48 is removed via conduit 234, cooled via inter-stage cooler 71, and returned to compressor 48 via conduit 236 for injection with the high-stage stream present in conduit 216. Preferably, the two-stages are a single module although they may each be a separate module and the modules mechanically coupled to a common driver. The compressed ethylene product from compressor 48 is routed to a downstream cooler 72 via conduit 200. The product from cooler 72 flows via conduit 202 and is introduced, as previously discussed, to high-stage propane chiller 2.

FIG. 2 illustrates the system for controlling the amount of methane refrigerant that is combined with the heavies removal column overheads (lights) stream in conduit 118. The system includes a methane refrigerant accumulation vessel 400 disposed in conduit 122. A level indicator 402 is operably connected to accumulation vessel 400. Level indicator 402 senses the level of the liquid methane refrigerant in accumulation vessel 400 and generates a signal 404 indicative of such level. A flow control unit 406 receives the level indicator signal 404 and generates flow control signals 408 and 410. Flow control valves 412 and 416 receive flow control signals 408 and 410, respectively. Flow control, valves 408 and 410 control the amount of flow through conduits 107 and 105, respectively, in response to flow control signals 408 and 410. In operation, when the level of liquid methane refrigerant in accumulation vessel 400 becomes undesirably high, valves 412 and 416 are automatically adjusted to allow more flow through conduit 107 and less flow through conduit 105. Conversely, when the level of liquid methane refrigerant in accumulation vessel 400 becomes undesirably low, valves 412 and 416 are automatically adjusted to allow more flow through conduit 105 and less flow through conduit 107. This system allows the amount of refrigerant in the methane refrigeration cycle to be maintained at the proper level without requiring flaring of excess methane refrigerant.

Referring again to FIG. 1, the methane refrigerant stream exiting low-stage ethylene chiller 68 is conducted to main methane economizer 74 for further cooling via indirect heat exchange means 76. The further cooled methane refrigerant then exits main methane economizer 74 via conduit 123 and, as described in detail below, is used as a refrigerant to sequentially cool the overheads (lights) streams from originating columns 60 and 61 in methane heat exchangers 63, 71, and 73. The methane-rich processed natural gas streams in conduits 120 and 124 are both sequentially cooled in a parallel fashion in methane heat exchangers 63, 71, and 73. It is preferred for methane heat exchangers 63, 71, and 73 to be separate from one another, with each methane heat exchanger 63, 71, and 73 having two indirect heat exchange passes for cooling the streams originating from conduits 120 and 124 without combining these streams. Most preferably, methane heat exchangers 63, 71, and 73 are core-in-kettle type heat exchangers with brazed aluminum cores.

Methane heat exchangers 63, 71, and 73 cool the methane-rich processed natural gas streams originating from conduits 120 and 124 via indirect heat exchange with the predominately methane refrigerant originating from conduit 123. It is preferred for methane heat exchangers 63, 71, and 73 to cooperatively cool the methane-rich processed natural gas streams from conduits 120 and 124 at least about 40° F., more preferably at least about 60° F., and most preferably at least 100° F., so that the liquefied natural gas streams exiting final methane heat exchanger 73 via conduits 135 and 137 are cooled to a level where they comprise less than 5 mole percent vapor. Further, it is preferred for the pressure drop between the streams in conduits 120 and 124 and the streams in conduits 137 and 135, respectively, to be less than 50 psi, more preferably less than 25 psi, and most preferably less than 10 psi. One possible advantage of the methane refrigeration cycle depicted in FIG. 1 is that, as opposed to a traditional open-loop methane cycle, the streams in conduits 120 and 124 need not be fully liquefied prior to the cooling provided in methane heat exchangers 63, 71, and 73. In fact, the streams in conduits 120 and 124 can comprise 25 mole percent vapor, or more.

The semi-closed loop methane refrigeration cycle will now be described in detail. The processed methane-rich natural gas streams in conduits 120 and 124 are cooled in first methane heat exchanger 63 in indirect heat exchange means 90 and 78, respectively, via indirect heat exchange with the predominately methane refrigerant. Prior to entering first methane heat exchanger 63, the predominately methane refrigerant in conduit 123 is flashed via pressure-reducing means 78, which is preferably an expansion valve. The vaporized predominately methane refrigerant exits first methane heat exchanger 63 via conduit 126. This gaseous predominately methane refrigerant stream in conduit 126 is then introduced into main methane economizer 74 wherein the gaseous stream is warmed in indirect heat exchange means 82. The warmed gaseous predominately methane refrigerant stream from indirect heat exchange means 82 exits main methane economizer and is conducted to the high stage of methane compressor 83 via conduit 128. The liquid phase predominately methane refrigerant exits first methane heat exchanger 63 via conduit 130. The liquid predominately methane refrigerant in conduit 130 is subsequently flashed in pressure reducer 91, which is preferably an expansion valve, and then introduced into second methane heat exchanger 71.

The processed natural gas streams cooled in first methane heat exchanger 63 via indirect heat exchange means 90 and 78 are withdrawn from first methane heat exchanger 63 via conduits 125 and 127, respectively. The processed natural gas stream in conduit 127 is conducted to a second methane economizer 65 wherein it is cooled in indirect heat exchange means 88 via indirect heat exchange with the gaseous predominately methane refrigerant exiting second methane heat exchanger 71 via conduit 136. The cooled stream from indirect heat exchange means 88 of second methane economizer 65 is then passed through a conduit 132 to second methane heat exchanger 71. The processed natural gas stream cooled via indirect heat exchange means 90 in first methane heat exchanger 63 is passed to second methane heat exchanger 71 via conduit 125.

In a second methane heat exchanger 71, the processed natural gas streams introduced via conduits 125 and 132 are cooled in indirect heat exchange means 33 and 79, respectively. The predominately methane refrigerant used to cool the streams in indirect heat exchange means 33 and 79 includes a gas phase, which is discharged from second methane heat exchanger 71 via conduit 136, and a liquid phase, which is discharged from second methane heat exchanger 71 via conduit 129. As mentioned above, the gaseous predominately methane refrigerant in conduit 136 is introduced into second methane economizer 65 where it is employed in indirect heat exchange means 89 to cool the stream in indirect heat exchange means 88. The warmed gaseous predominately methane refrigerant in indirect heat exchange means 89 exits second methane economizer 65 via conduit 138. Conduit 138 carries the gaseous predominately methane refrigerant to main methane economizer 74 wherein the stream is further warmed in indirect heat exchange means 95. The warmed gaseous predominately methane refrigerant from indirect heat exchange means 95 exits main methane economizer 74 and is carried to the intermediate stage inlet of methane compressor 83 via conduit 140. The liquid predominately methane refrigerant discharged from second methane heat exchanger 71 via conduit 129 is flashed in pressure-reducing means 92, which is preferably an expansion valve, and subsequently introduced into third methane heat exchanger 73.

The processed natural gas streams discharged from second methane heat exchanger 71 via conduits 33 and 31 are introduced into third methane heat exchanger 73 for further cooling in indirect heat exchange means 35 and 39, respectively. In indirect heat exchange means 35 and 39, the processed natural gas streams are cooled via indirect heat exchange with the predominately methane refrigerant. The predominately methane refrigerant exits third methane heat exchanger 73 via conduit 143. The processed natural gas stream cooled in indirect heat exchange means 35 is discharged from third methane heat exchanger 73 via conduit 137. The processed natural gas stream cooled in indirect heat exchange means 39 is discharged from third methane heat exchanger 73 via conduit 135. The cooled natural gas streams in conduits 135 and 137 are flashed in pressure-reducing means 93 and 94, respectively, with the resulting flash streams being subsequently combined in tee 43. The combined stream from tee 43 is conducted via conduit 139 to a separator vessel 75. Separator vessel 75 is operable to separate the predominantly liquid and predominantly gas phases of the stream introduced via conduit 139. Liquefied natural gas (LNG) exits separator 75 via conduit 142. The LNG product from separator vessel 75, which is at approximately atmospheric pressure, is passed through conduit 142 to a LNG storage tank. In accordance with conventional practice, the liquefied natural gas in the storage tank can be transported to a desired location (typically via an ocean-going LNG tanker). The LNG can then be vaporized at an onshore LNG terminal for transport in the gaseous state via conventional natural gas pipelines.

Predominately methane vapors exit separator vessel 75 via conduit 141 and are subsequently combined with the predominately methane refrigerant from conduit 143 in tee 41. Thus, tee 41 represents the only location in the semi-closed loop methane refrigeration cycle where a portion of the processed natural gas stream is introduced into the predominately methane refrigerant stream. The combined stream from tee 41 is conducted via conduct 144 to second methane economizer 65 where the combined stream is warmed in indirect heat exchange means 90. The warmed stream from indirect heat exchange means 90 exits second methane economizer 65 via conduit 146. The predominately methane refrigerant stream in conduit 146 is introduced into indirect heat exchange means 96 of main methane economizer 74, wherein the stream is further warmed. The resulting warmed predominately methane refrigerant stream exits main methane economizer 74 and is transferred to the low-stage inlet of methane compressor 83 via conduit 148.

As shown in FIG. 1, the high, intermediate, and low stages of methane compressor 83 are preferably combined as single unit. However, each stage may exist as a separate unit where the units are mechanically coupled together to be driven by a single driver. The compressed gas from the low-stage section passes through an inter-stage cooler 85 and is combined with the intermediate pressure gas in conduit 140 prior to the second stage of compression. The compressed gas from the intermediate stage of compressor 83 is passed through an inter-stage cooler 84 and is combined with the high pressure gas provided via conduits 121 and 128 prior to the third-stage of compression. The compressed gas (i.e., compressed open methane cycle gas stream) is discharged from high stage methane compressor through conduit 150, is cooled in cooler 86, and is routed to the high pressure propane chiller 2 via conduit 152 as previously discussed. The stream is cooled in chiller 2 via indirect heat exchange means 4 and flows to main methane economizer 74 via conduit 154. The compressed open methane cycle gas stream from chiller 2 which enters the main methane economizer 74 undergoes cooling in its entirety via flow through indirect heat exchange means 98. This cooled stream is then removed via conduit 158 and combined with the processed natural gas feed stream upstream of the first stage of ethylene cooling.

In one embodiment of the present invention, the LNG production systems illustrated in FIGS. 1 and 2 are simulated on a computer using conventional process simulation software. Examples of suitable simulation software include HYSYS™ from Hyprotech, Aspen Plus® from Aspen Technology, Inc., and PRO/II® from Simulation Sciences Inc.

The preferred forms of the invention described above are to be used as illustration only, and should not be used in a limiting sense to interpret the scope of the present invention. Obvious modifications to the exemplary embodiments, set forth above, could be readily made by those skilled in the art without departing from the spirit of the present invention.

The inventors hereby state their intent to rely on the Doctrine of Equivalents to determine and assess the reasonably fair scope of the present invention as pertains to any apparatus not materially departing from but outside the literal scope of the invention as set forth in the following claims.

What is claimed is:

1. A method for liquefying a natural gas stream comprising the steps of:

providing a liquefied natural gas facility having at least three sequential cooling cycles, each employing a different refrigerant;

wherein the at least three sequential cooling cycles comprise a first cooling cycle with a first refrigerant, a second cooling cycle with a second refrigerant, and a third cooling cycle with a third refrigerant, wherein the third refrigerant is a predominantly methane refrigerant;

wherein the third cooling cycle comprises an open-loop methane refrigeration cycle;

cooling the natural gas stream in the first cooling cycle with the first refrigerant;

cooling the natural gas stream in the second cooling cycle with the second refrigerant;

introducing the natural gas stream to a heavies removal column for separating the natural gas stream into a heavies stream and a heavies-reduced natural gas stream;

compressing a predominantly methane stream to form a compressed methane refrigerant;

separating the compressed methane refrigerant into a first compressed methane refrigerant portion and a second compressed methane refrigerant portion;

cooling the first compressed methane refrigerant portion in the second cooling cycle via indirect heat exchange with the second refrigerant to form a cooled intermediate refrigerant;

combining the cooled intermediate refrigerant with the second compressed methane refrigerant portion to form an intermediate refrigerant stream;

separating the intermediate refrigerant stream into a third compressed methane refrigerant portion and a fourth compressed methane refrigerant portion;

introducing the heavies-reduced natural gas stream into the open-loop methane refrigeration cycle by combining the heavies-reduced natural gas stream with the third compressed methane refrigerant portion to form a combined stream;

introducing the combined stream into a methane economizer for cooling to form a first natural gas stream;

cooling the fourth compressed methane refrigerant portion in the second cooling cycle via indirect heat exchange with the second refrigerant to form a cooled methane refrigerant product;

introducing the cooled methane refrigerant product to a methane refrigerant accumulation vessel wherein a liquid level is formed in the methane refrigerant accumulation vessel;

controlling a liquid level in the methane refrigerant accumulation vessel by adjusting a flow of the third compressed methane refrigerant portion with respect to a flow of the fourth compressed methane refrigerant portion to maintain the liquid level in the methane refrigerant accumulation vessel;

introducing the cooled methane refrigerant product from the methane refrigerant accumulation vessel into the methane economizer for cooling to form the predominately methane refrigerant;

cooling the first natural gas stream in a plurality of separate heat exchangers via indirect heat exchange with the predominately methane refrigerant to form a liquefied natural gas product and a vapor portion of the first natural gas stream;

combining a portion of the predominately methane refrigerant with the vapor portion of the first natural gas stream to form part of the predominantly methane stream that is compressed.

2. The method of claim 1 wherein the step of controlling the liquid level in the methane refrigerant accumulation vessel ensures a single phase fluid (liquid) being introduced to the methane economizer in the step of introducing the cooled methane refrigerant product from the methane refrigerant accumulation vessel into the methane economizer.

3. The method of claim 1 wherein the first refrigerant comprises propane and wherein the second refrigerant comprises predominantly ethylene.

4. The method of claim 1 wherein the first refrigerant comprises predominantly propane.

5. The method of claim 1 wherein the first refrigerant comprises predominantly propylene.

6. The method of claim 1 wherein the first refrigerant comprises predominantly carbon dioxide.

7. The method of claim 1 wherein the second refrigerant is predominantly ethylene.

8. The method of claim 1 wherein the second refrigerant is predominantly ethane or carbon dioxide.

* * * * *